US005297785A

United States Patent [19]

Ricciardi

[11] Patent Number: 5,297,785

[45] Date of Patent: Mar. 29, 1994

[54] PRE-FEED SHINGLING DEVICE FOR FLAT-ARTICLE FEEDER

[75] Inventor: Mario Ricciardi, Glenview, Ill.

[73] Assignee: Bell & Howell Phillipsburg Company, Evanston, Ill.

[21] Appl. No.: 935,775

[22] Filed: Aug. 28, 1992

[51] Int. Cl.[5] ..... B65H 3/00; B65H 5/00

[52] U.S. Cl. ..... 271/3; 271/225; 271/113; 271/150

[58] Field of Search ..... 271/3, 116, 149, 150, 271/179, 251, 146, 113, 151, 225

[56] References Cited

U.S. PATENT DOCUMENTS

| | | | |
|---|---|---|---|
| 458,945 | 9/1891 | Crane | 271/251 |
| 650,410 | 5/1900 | Morin . | |
| 3,817,516 | 6/1974 | Lazzarotti et al. | 271/150 |
| 3,966,193 | 6/1976 | Storace et al. | 271/150 |
| 3,988,017 | 10/1976 | Kyhl | 271/111 |
| 4,030,723 | 6/1977 | Irvine et al. | 271/11 |
| 4,270,747 | 6/1981 | Templeton | 271/179 |
| 4,299,379 | 11/1981 | Preston | 271/149 X |
| 4,598,901 | 7/1986 | Thomas | 271/202 |
| 4,718,809 | 1/1988 | Krasuki et al. | 414/129 |
| 4,757,985 | 7/1988 | Hamant | 271/149 X |
| 4,884,797 | 12/1989 | Suyatsky | 271/150 X |
| 4,891,088 | 1/1990 | Suyatsky | 271/150 X |
| 4,955,596 | 9/1990 | Ricciardi | 271/110 |
| 4,979,730 | 12/1990 | Holbrook et al. | 271/265 |
| 4,982,942 | 1/1991 | Konishi et al. | 271/119 |

FOREIGN PATENT DOCUMENTS

| | | | |
|---|---|---|---|
| 52139 | 3/1983 | Japan | 271/150 |

*Primary Examiner*—H. Grant Skaggs

*Attorney, Agent, or Firm*—Millen, White, Zelano, & Branigan

[57] ABSTRACT

A transport mechanism for transporting flat documents placed therein on edge uses a horizontal conveyor belt to convey stacks of documents on-edge in a first feeding direction. Tapered rollers with a feeding direction perpendicular to that of the conveyor belt are provided at the end of the conveyor for feeding the documents in a direction perpendicular to the first feeding direction. The use of tapered rollers allows a gradual, rather than sudden, perpendicular velocity to be imparted to the documents, thereby relieving strain on the roller drive mechanism, the rollers themselves, and the documents at high machine throughput speeds. The use of tapered rollers also provides a shingled output of documents, which allows a stripping station down-line from the feeder to strip the documents with fewer misfeeds and less strain.

6 Claims, 3 Drawing Sheets

PRE-FEED SHINGLING DEVICE FOR FLAT-ARTICLE FEEDER

BACKGROUND OF THE INVENTION

1. Field of the Invention

The invention relates to document transport devices for use in document handling machines, and particularly to document transport devices utilizing a conveyor belt for transporting documents on-edge in a vertically-oriented, upright position.

2. Related Art

Document handling machines which convey mail on-edge, that is, where the plane of the mail item is vertical while it is conveyed by a horizontal belt, are well-known. A document handling machine of this type is taught in commonly-assigned U.S. Pat. No. 4,955,596, which is incorporated herein by reference. Generally, such machines convey a series of envelopes between stations which perform various operations, such as bar-code reading, bar-code printing, and sorting.

Because mail items are delivered to the machine in stacks, a feeder which singulates the stacks of mail into a series of end-to-end, vertically oriented, individual items is required. This conversion step often uses a ninety-degree change of direction in the envelope path, which is accomplished by a series of feed rollers oriented so as to feed in a direction perpendicular to the feed path of incoming stacks of documents. This sudden change of direction requires great force when the machine is operating at high throughput speeds, and results in undesirable wear on the perpendicularly-oriented feed roller drive mechanism, the rollers themselves, and the documents being transported. The machines of the prior art do not provide a solution to this problem of undesirable wear. Further, the machines of the prior art have been plagued with the problem of misfeeds and excessive forces on the feeder mechanism, both of which are the result of multiple envelopes being delivered to the feeder simultaneously.

SUMMARY

It is an object of the present invention to solve the above-noted problems by decreasing the forces bearing upon the drive rollers of a ninety-degree feeder while at the same time providing a "shingled" stream of envelopes to the feeder. This is accomplished by the use of tapered perpendicularly-oriented drive rollers in the feeder mechanism described above.

As envelopes of a stack standing on-edge move down a conveyor they encounter a series of tapered drive rollers which are oriented so that their direction of feeding is perpendicular to the path on which the envelopes are currently travelling. Since the tips of the perpendicularly-oriented rollers, which are first encountered by the envelopes, have a diameter which is smaller than that of the base of the rollers, the perpendicular velocity of the documents will be subject to a gradual acceleration, rather than a sudden one. This gradual acceleration reduces wear on both the perpendicularly-oriented rollers and the envelopes.

A further advantage of the invention is that the tapered rollers cause the documents to be shingled when they reach the feeder, thus reducing the number of misfeeds and reducing the forces bearing upon the feeder mechanism at any given time.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating principles of the invention. In the drawings.

DETAILED DESCRIPTION OF THE DRAWINGS

Figure 1:
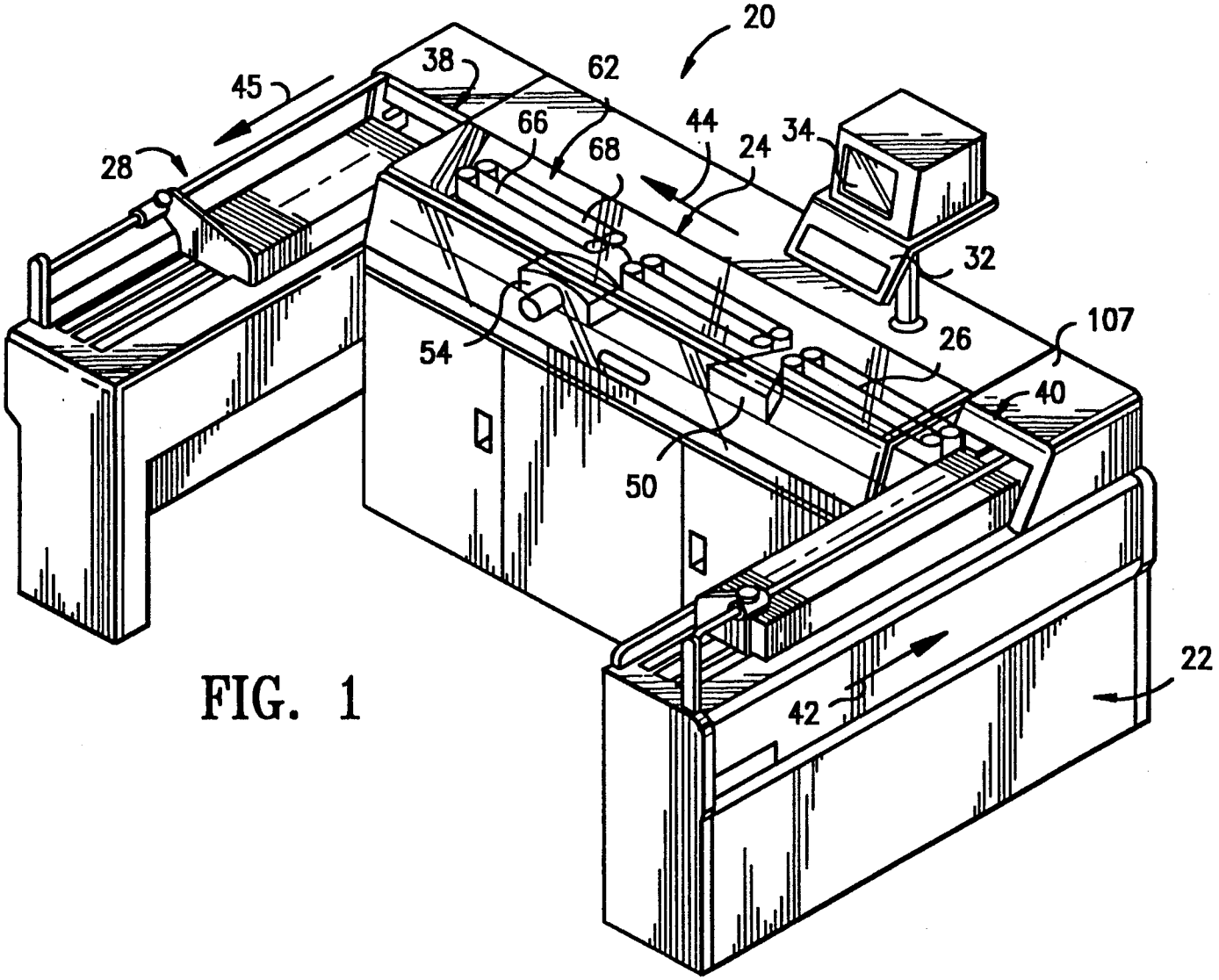
FIG. 1 is a schematic view of a document handling machine to which the present invention can be applied.

FIG. 1 shows a system 20 for processing flat articles, such as envelopes. Examples of such processing include, but are not limited to, sorting, labeling with a bar code, and inserting documents in envelopes. System 20 comprises an input transport section 22; a processing/-transport section 24 wherein flat articles, such as envelopes, are transported along a processing path 26; and a discharge transport section comprising a stacker 38 and a storage section 28. The processing system 20, hereinafter also referred to as an envelope processing system 20, also includes a keyboard 32; a monitor 34; and a printer 54. Envelopes are delivered to input transport section 22 in upright stacks and are fed on-edge from the input transport section 22 through a ninety-degree angle to the processing/transport section 24 via feeder section 40. The envelopes travel on-edge and one-at-a-time through the processing/transport section 24. From the processing/transport section 24 the envelopes are loaded onto the storage section 28 by stacker 38.

The direction of envelope travel on the input transport section 22 is shown by arrow 42; the direction of envelope travel from section 22 onto the processing/-transport section 24 as propelled by the feeder section 40 is shown by the arrow 44; and the direction of envelope travel into the storage section 28 is shown by arrow 45. The direction of envelope travel on the processing/transport section 24 is perpendicular to the direction of envelope travel on the input transport section 22 and the storage section 28.

In the particular embodiment under discussion, the processing/transport section 24 directs envelopes along the processing path 26 which has reader means 50; a detector photocell (not shown); and bar code printer means 54 positioned therealong. It should be understood that in other embodiments of the invention, other and/or additional functions can be performed along the processing path 26.

Envelopes are transported on-edge through the processing/transport section 24 in the direction of arrow 44 by a transport system 62 which includes a series of revolving horizontal belts (not shown) and a series of revolving vertical belts, including front vertical belts 66 and back vertical belts 68. The bottom edges of envelopes ride on the horizontal belts, while the front sidewalls and back sidewalls of the envelopes are contacted by the belts 66 and 68, respectively.

Figure 2:
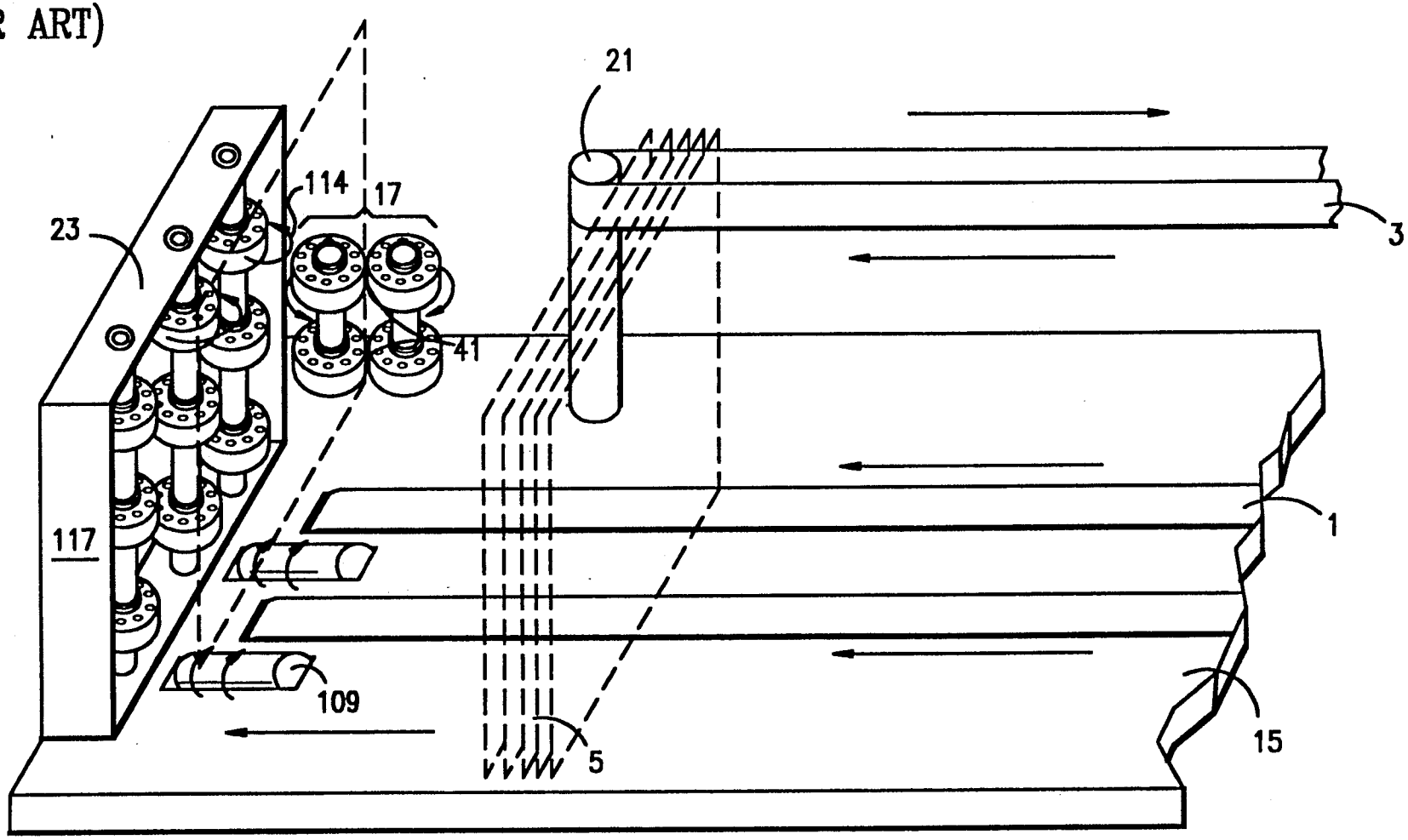
FIG. 2 (PRIOR ART)
FIG. 2 is a schematic view of an input transport section of the prior art.

FIG. 2 shows an input transport section according to the prior art. The input transport section comprises a transport table 15 for transporting documents such as envelopes. Transport table 15 comprises a pair of horizontally-oriented feed belts 1 which act in conjunction with a vertically-oriented feed belt 3 to deliver mail items 5 in a first feeding direction to a pair of rollers 109. Rollers 109 are driven from below the table top and are only partially exposed above the table top through an opening therein. The rollers 109 are rotating in a clockwise direction when viewed from the right in FIG. 1 so as to feed in a second feeding direction, perpendicular to the first feeding direction, into nip 41 of feeder 17, which is schematically illustrated here as a set of nip rollers. The feeder 17 can also take on other known forms, such as that of a singulator plate pressed against a drive belt running in the second feeding direction. A set of assist rollers 23 may be provided for applying additional force to documents in the second feeding direction. The assist rollers 23 are encased in a housing 117 and are driven by a drive means (not shown) so as to rotate in the direction indicated by arrow 114.

The feeder 17 is operative to convert the stream of overlapping documents into a series of single, closely-spaced documents which are suitable for individual processing. As discussed above with reference to FIG. 1, examples of such processing include, but are not limited to, sorting, labeling, and inserting the documents in envelopes or the like.

Figure 3:
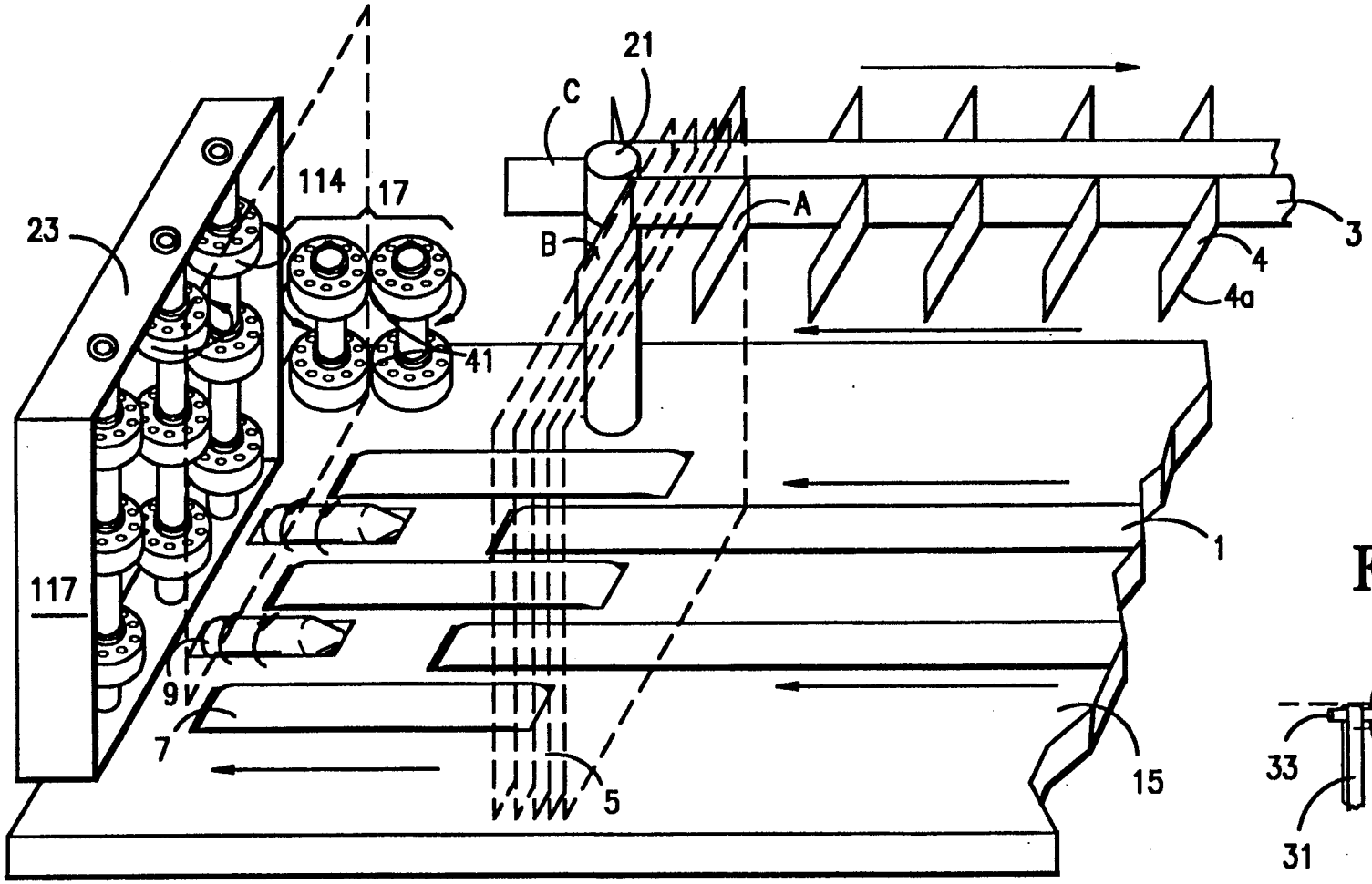
FIG. 3 is a schematic view of the input transport section according to an embodiment of the invention.

FIG. 3 shows an input transport section according to the invention. The input transport section comprises a transport table 15 for transporting documents such as envelopes. Transport table 15 comprises a pair of horizontally-oriented feed belts 1 which act in conjunction with segment flaps 4 on a segmented, vertically-oriented feed belt 3 to deliver groupings of mail items 5 in a first feeding direction to one or more take-away belts 7 moving at an accelerated speed with reference to feed belts 1. The feed belt 3 moves in the direction as designated by arrow 3*a* and around a cylinder post 6; and the tips 4*a* move at a higher linear velocity as they round the post 6. Hence, the accelerated speed of take-away belts 7 is necessary in order to match or exceed the acceleration of each given document by the tips 4*a* of segment flaps 4 which push the documents at a greater speed, for example, between positions B and C than between positions A and B. Moreover, absent the use of accelerated take-away belts, a document would tend to turn along with its associated flap as that flap moves from point B to point C.

The take-away belts 7 continue to move the mail in the first feeding direction, toward a pair of tapered rollers 9. The tapered rollers 9 are rotating in a clockwise direction when viewed from the right in FIG. 1 so as to feed in a second feeding direction, perpendicular to the first feeding direction, into nip 41 of feeder 17, the operation of which is discussed above with reference to FIG. 2. In the embodiment shown, two tapered rollers are used. However, additional tapered rollers could be used at an additional cost for increased consistency of feeding.

A further feature of the invention relates to assist rollers 23. Assist rollers 23 are provided to prevent "stalling" of the mail items. "Stalling" occurs when two or more mail items stick together and, as a result, lag momentarily when being being fed toward a feeder such as feeder 17 of the present invention. Such sticking may be due to any one of a number of factors, including excessive humidity, static electricity, and leakage of glue from an envelope's flap seal. However, it has been discovered that using assist rollers to drive stalled documents into a feeder at speeds equal to or greater than the feeding speed of the feeder will result in a certain amount of jamming of envelopes at the feeder. This jamming can result, for example, from any slight excess feeding speed of the assist rollers over that of the feeder, or from any slight delay in take-up of the envelope as its leading edge reaches the feeder.

On the other hand, it has been discovered that using assist rollers which drive stalled envelopes into a feeder at a constant feeding speed below that of the feeder is also undesirable because when the stalled envelope reaches the feeder, and is accelerated by it, there is an excessive amount of friction between the envelope and the slower-moving assist rollers. This friction restrains the envelope as it is being acted-upon by the feeder, and thus results in feeding which is inconsistent with that of other, non-stalled, envelopes.

The present invention provides a set of assist rollers 23 which are driven by a shaft that includes a one-way clutch. The assist rollers 23 are driven via a conventional one-way clutch (not shown) at a feeding speed which is less than that of the feeder 17. Because the one-way clutch allows the rollers to spin freely at the accelerated speed of the feeder 17 once the feeder 17 engages a stalled envelope, the assist rollers 23 can be operated at a slower feeding speed relative to that of the feeder 17 without imparting to the driven envelope the undesirable friction discussed above.

A further advantage to the use of accelerated take-away belts 7 is that the difference in velocity between the speed of feed belt 3 and take-away belts 7 causes a spatial separation between successive documents after they have passed onto the take-away belts 7. This spatial separation amounts to a decrease in compactness of a stack of envelopes being fed, and thereby results in greater ease-of-shingling of the envelopes at the tapered rollers 9.

Figure 4:
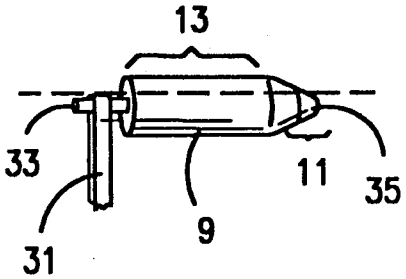
FIG. 4 is a schematic view of a tapered roller according to an embodiment of the invention.

FIG. 4 shows a tapered roller which is partially exposed above table top 15 by means of openings therein. Drive belt 31, driven by a drive means (not shown) drives shaft 33 so as to cause rotation of roller 9 about a central axis. Because of the smaller diameter at the tip portion 11 of the rollers 9, the rollers will feed a document which is in contact with the tip portion at a lower velocity than that which is imparted to a document which is in contact with the central region 13 of the rollers.

The effect of the taper is as follows. As a document moves into contact with the tip portions 11 of the tapered rollers, a perpendicular velocity is imparted to the document. This perpendicular velocity is initially small, and becomes increasingly large as the document moves towards and into contact with the central region 13 of the roller. As a result, the documents are gradually accelerated into the nip 41 rather than being suddenly accelerated as has resulted where the rollers 9 were not tapered. When the machine is operating at high throughput speeds, this more gradual acceleration is very significant, and results in a reduction of wear on all moving parts involved in the perpendicular feeding operation, including the roller-drive mechanisms, the rollers, and the documents themselves.

While the invention has been particularly shown and described with reference to a preferred embodiment thereof, it will be understood by those skilled in the art that various changes in form and details may be made therein without departing from the spirit and scope of the invention.

The embodiments of the invention in which an exclusive property or privilege is claimed are defined as follows:

1. A transport section for transporting flat documents placed therein on-edge, comprising:

first transport means for accepting and conveying said flat documents in an upright, vertical orientation in a first feeding direction substantially perpendicular to the plane of said flat documents;

at least one tapered roller disposed at an end portion of said first transport means and oriented so as to have a feeding direction substantially perpendicular to said first feeding direction for receiving said flat documents and for imparting to said flat documents a gradual velocity in a direction substantially perpendicular to said first feeding direction, whereby said flat documents are caused to be transmitted in a shingled form; and means for accepting said flat documents in said shingled form and for delivering said documents in a second feeding direction parallel to the plane in which said flat documents then lie, said second feeding direction being substantially perpendicular to said first feeding direction.

2. The transport section according to claim 1, wherein said first transport means comprises a horizontally-disposed conveyor belt.

3. The transport section according to claim 2, further comprising a transport table top above which said horizontally-disposed conveyor belt and said tapered roller are partially exposed through respective openings in said table top.

4. The transport section according to claim 1, wherein said means for accepting said flat documents in said shingled form comprises means for separating said flat documents in said shingled form into a stream of single documents.

5. The transport section according to claim 1, further comprising at least one vertically-oriented assist roller disposed at an end portion of said conveyor belt and driven in a direction so as to impart to documents in contact with said assist roller a force toward said second feeding direction.

6. A device for processing flat documents, comprising:

an input transport section further comprising a horizontally-disposed conveyor belt for accepting and conveying said flat documents in an upright, vertical orientation in a first feeding direction perpendicular to the plane of said flat documents;

at least one tapered roller disposed at an end portion of said conveyor belt and oriented so as to have a feeding direction substantially perpendicular to said first feeding direction for receiving said flat documents and for imparting to said flat documents a gradual velocity in a second feeding direction substantially perpendicular to said first feeding direction, whereby said flat documents are caused to be transmitted in a shingled form;

a feeder for accepting said flat documents in said shingled form and for delivering said documents in said second feeding direction and for separating said flat documents in said shingled form into a stream of single documents;

a processing/transport section comprising a second transport means for accepting said stream of single documents from said feeder and for transporting said documents past at least one processing station, said at least one processing station performing on said stream of single documents at least one of the processing steps of sorting, labeling, or inserting the documents in envelopes; and a discharge transport section comprising a stacker and a storage section, said stacker accepting said single documents from said processing/transport section and delivering said documents to said storage section in a stacked form.

* * * * *